United States Patent [19]

Falxa

[11] 4,431,729

[45] Feb. 14, 1984

[54] METHOD FOR PREPARING PHOTOSENSITIVE SILVER HALIDE EMULSIONS

[75] Inventor: Martin L. Falxa, Cambridge, Mass.

[73] Assignee: Polaroid Corporation, Cambridge, Mass.

[21] Appl. No.: 406,323

[22] Filed: Aug. 9, 1982

[51] Int. Cl.[3] ..... G03C 1/02

[52] U.S. Cl. ..... 430/569; 430/567

[58] Field of Search ..... 430/569, 567

[56] References Cited

U.S. PATENT DOCUMENTS

| | | | |
|---|---|---|---|
| 3,736,144 | 5/1973 | Nagae et al. | 430/569 |
| 3,773,516 | 11/1973 | Gutoff | 430/569 |
| 4,259,438 | 3/1981 | Falxa et al. | 430/569 |

FOREIGN PATENT DOCUMENTS

| | | |
|---|---|---|
| 1298119 | 11/1972 | United Kingdom . |
| 1305409 | 1/1973 | United Kingdom . |

*Primary Examiner*—Mary F. Downey

*Attorney, Agent, or Firm*—Philip G. Kiely

[57] ABSTRACT

A method for preparing a narrow-grain size distribution silver iodobromide emulsion which comprises precipitating silver iodobromide grains by simultaneously introducing an ammoniacal solution of silver nitrate and a solution of ammonium bromide into an ammoniacal solution consisting essentially of gelatin and a water-soluble iodide salt under conditions where silver ions are not in excess during said precipitation.

10 Claims, 13 Drawing Figures

METHOD FOR PREPARING PHOTOSENSITIVE SILVER HALIDE EMULSIONS

BACKGROUND OF THE INVENTION

It is known in the art to prepare photosensitive silver halide grains in the presence of ammonia. For example, on page 61 of *Photographic Emulsion Chemistry,* G. F. Duffin, The Focal Press, New York, 1966, it is stated that ammonia is generally introduced into the silver halide precipitation procedure either in the silver solution or alternatively in the halide gelation solution and/or in the added halide in a double jet procedure. Examples of such procedures also appear in the patent art.

U.S. Pat. Nos. 2,005,837; 2,184,013; 2,576,850; 3,598,593 and 3,647,458 describe various methods for preparation of silver halide grains which employ ammoniacal silver nitrate solutions.

U.S. Pat. No. 4,259,438, issued Mar. 31, 1981, is directed to a method for forming photosensitive silver halide grains which comprises the steps of simultaneously introducing into an aqueous solution of gelatin and ammonium halide, an ammoniacal solution of silver nitrate and a second solution of an ammonium halide. More specifically, silver halide grains substantially uniform in size, having a 0.5–10% iodide content and wherein the core is iodide-rich compared to the rest of the grain are prepared by simultaneously introducing into an aqueous solution of gelatin, ammonium bromide and a water-soluble iodide salt, an ammoniacal solution of silver nitrate and a solution of ammonium bromide or chloride.

On page 61 of Duffin, referred to above, it is also stated that:

> "Iodobromide emulsions usually contain between 20% and 250% excess bromide during precipitating and ripening: those for negative purposes commonly containing the highest amounts while X-ray emulsions have the lowest."

SUMMARY OF THE INVENTION

The present invention is directed to a method for forming a narrow grain size distribution silver iodobromide emulsion which comprises precipitating silver iodobromide grains by introducing a first ammoniacal solution of silver nitrate and a second solution of ammonium bromide into a third ammoniacal solution consisting essentially of gelatin and a water-soluble iodide salt under conditions where silver ions are not in excess during said precipitation.

Figure 1:
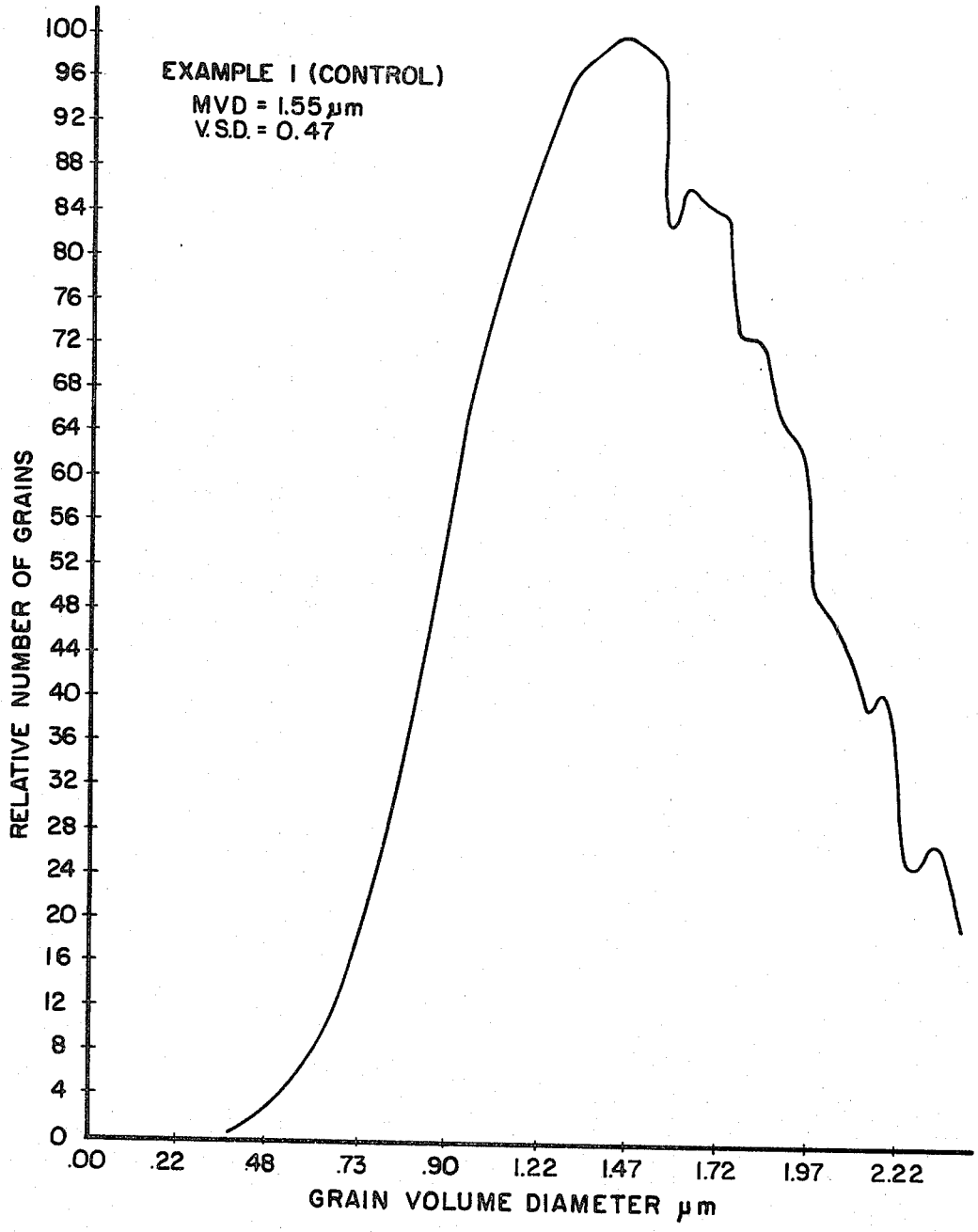
FIGS. 1–10 are grain size distribution curves obtained on the emulsions prepared in the Examples.

To obtain the grain size distribution curves 30,000±10% grains were counted and a shape factor was applied.

DETAILED DESCRIPTION OF THE INVENTION

The present invention is directed to a method for forming a high speed narrow grain size distribution silver iodobromide emulsion by simultaneously introducing an ammoniacal silver nitrate solution and a solution of ammonium bromide or ammonium bromide and a water-soluble halide salt into an ammoniacal solution of gelatin and water-soluble iodide salt, wherein the iodide salt is the sole water-soluble halide in the reaction vessel, or, as will be described below, the essential water-soluble halide. As stated above, the art has conventionally prepared emulsions with a significant excess of bromide ion during the precipitation. In contrast, the novel method of the present invention employs either no bromide excess or only a slight excess. Preferably, the grains prepared by the method of the present invention contain about a 0.5–25% mole percent of iodide and more preferably 0.65 to 14 mole. The iodide is placed on the reaction vessel during precipitation.

In a preferred embodiment, ammonium iodide is the sole water-soluble halide in the reaction vessel while the siliver nitrate and ammonium bromide are jetted therein. Thus, the ammonium ions in the reaction vessel would be provided by ammonium iodode. It is also stated above that the precipitation is carried out under conditions which do not permit an excess of silver ions during said precipitation to prevent fog formation. One method of insuring that an excess of silver ions does not occur is by a feed control system on the jets thereby regulating the feed of one stream of reactant relative to the other. Alternatively, an excess of silver ions during the precipitation can be avoided by including in the reaction vessel, with the gelatin and water-soluble iodide salt, a small amount of water-soluble bromide, i.e., less than 4 mole percent bromide. Thus, if ammonium bromide is employed, the ammonium ions will be provided by this salt, and it would not be necessary to employ ammonium iodide in this case. It will be seen by reference to the examples that bromide ion at this level will still provide a narrow grain size distribution as well as prevent the fog-producing silver ion excess, whereas greater bromide levels in the reaction vessel, i.e., those referred to above in conventional emulsion preparation, will not provide grains with the desired narrow grain size distribution.

At the end of the precipitation step, the grains of the present invention have a narrow grain size distribution. The thus-formed grains are then Ostwald ripened to the desired grain size while maintaining the narrow grain size distribution.

It will be noted that the novel method of the present invention employs the double jet mode of grain formation wherein ammonium ion in some form is present in each of the solutions involved in the precipitation of the silver halide grains. The term "ammoniacal", as used herein, is intended to refer to free ammonia and ammonium ion.

The derivatized gelatin employed in the following examples was phthaloyl bone gelatin.

EXAMPLE 1 (Control)

The following solutions were prepared:

| Solution 1 | |
|---|---|
| Distilled water | 905 g |

-continued

| | |
|---|---|
| Ammonium bromide | 92 g |
| Ammonium iodide | 10 g |
| Derivatized gelatin | 12 g |
| Solution 2 | |
| Distilled water | 499 g |
| Silver nitrate | 170 g |
| Ammonium hydroxide (29.5%) | 142 g |
| Solution 3 | |
| Distilled water | 602 g |
| Ammonium bromide | 98 g |

After Solution 1 was brought to 60° C., Solutions 2 and 3 are simultaneously jetted into Solution 1, with agitation, over a 18 minute period. Solution 2 had a flow rate of 45 g/min and Solution 3 had a flow rate of 39 g/min. The emulsion temperature was held at 60° C. for 20 min. and then lowered to 20° C. The emulsion was flocculated with sulfuric acid and washed until the conductivity was below 500 μmhos/cm. The emulsion was reconstituted by adjusting the pAg to 9.0 and the pH to 5.7 and adding inert deionized gelatin to give a gelatin/-silver ratio of 0.5.

FIG. 1 is a grain size distribution curve obtained on the emulsion prepared in Example 1.

EXAMPLE 2

| | |
|---|---|
| Solution 1 | |
| Distilled water | 1460 g |
| Ammonium iodide | 10 g |
| Derivatized gelatin | 6 g |
| Solution 2 | |
| Distilled water | 498 g |
| Silver nitrate | 170 g |
| Ammonium hydroxide (29.5%) | 127 g |
| Solution 3 | |
| Distilled water | 602 g |
| Ammonium bromide | 98 g |

After Solution 1 was brought to 60° C., Solutions 2 and 3 were simultaneously jetted into Solution 1, with agitation, over a 50 minute period. Solution 2 had a flow rate of 15.9 g/min and Solution 3 had a flow rate of 14 g/min. The emulsion temperature was held at 60° C. for 60 min. and then lowered to 20° C. The emulsion was flocculated with sulfuric acid and washed until the conductivity was below 500 μmhos/cm. The emulsion was reconstituted by adjusting the pAg to 9.24 and the pH to 5.7 and adding inert deionized gelatin to give a gelatin/silver ratio of 0.5.

Figure 2:
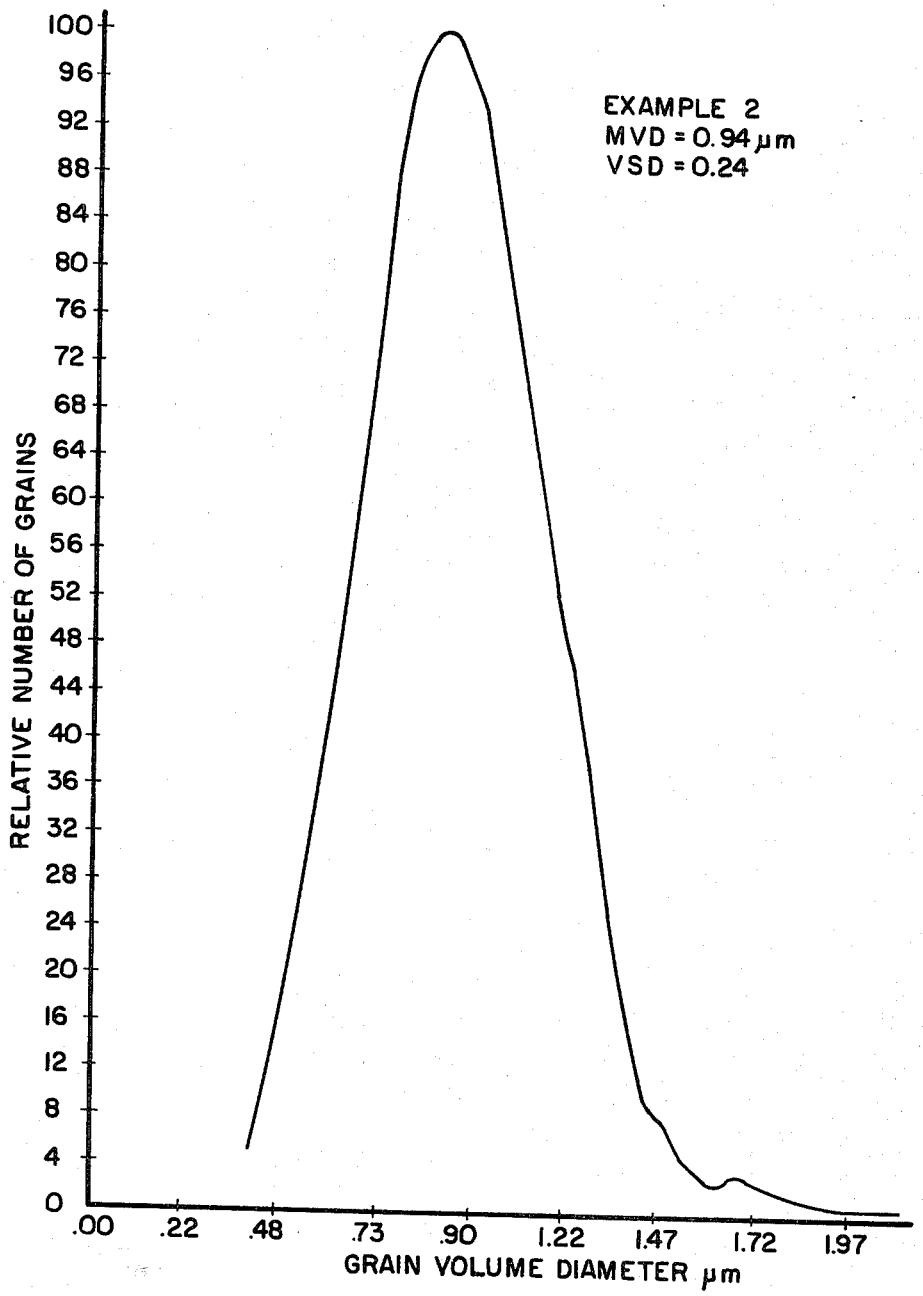

FIG. 2 is a grain size distribution curve obtained on the emulsion prepared in Example 2.

EXAMPLE 3

The following solutions were prepared:

| | |
|---|---|
| Solution 1 | |
| Distilled water | 1460 g |
| Ammonium iodide | 6.6 g |
| Deionized gelatin | 6.1 g |
| Solution 2 | |
| Distilled water | 498 g |
| Silver nitrate | 170 g |
| Ammonium hydroxide (29.5%) | 127 g |
| Solution 3 | |
| Distilled water | 601 g |
| Ammonium bromide | 98 g |

-continued

| | |
|---|---|
| Potassium iodide | 3.3 g |

After Solution 1 was brought to 60° C., Solutions 2 and 3 were simultaneously jetted into Solution 1, with agitation, over a 50 minute period. Solution 2 had a flow rate of 15.9 g/min. and Solution 3 had a flow rate of 14 g/min. The emulsion temperature was held at 60° C. for 60 min. and then lowered to 40° C. and neutralized with sulfuric acid. The emulsion was ultrafiltered until the conductivity was below 500 μmhos/cm. The emulsion was reconstituted by adjusting the pAg to 9.0 and the pH to 5.7 and adding inert deionized gelatin to give a gelatin/silver ratio of 0.5.

Figure 3:
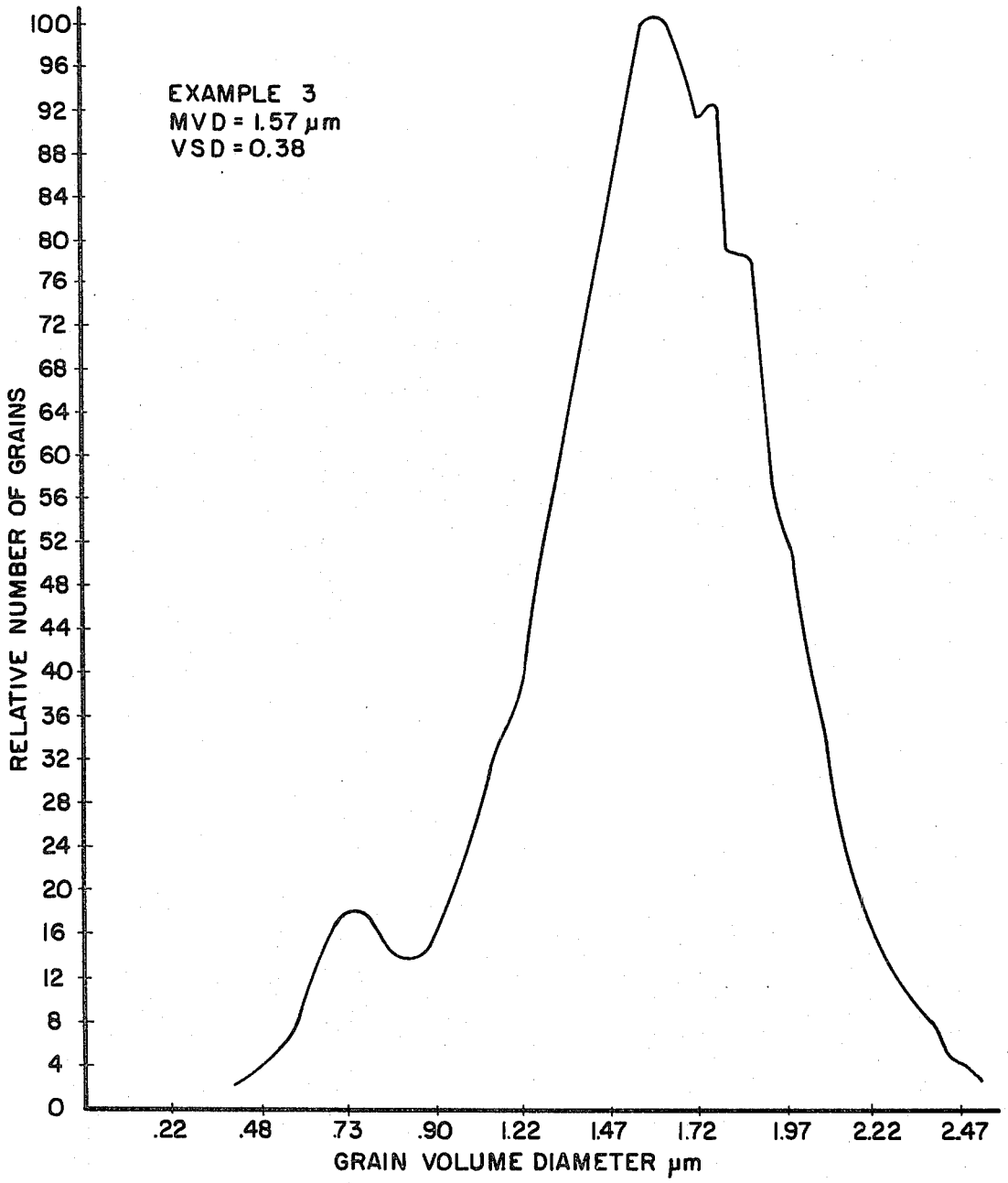

FIG. 3 is a grain size distribution curve obtained on the emulsion prepared in Example 3.

EXAMPLE 4

The following solutions were prepared:

| | |
|---|---|
| Solution 1 | |
| Distilled water | 1460 g |
| Ammonium iodide | 6.6 g |
| Derivatized gelatin | 6.1 g |
| Solution 2 | |
| Distilled water | 464 g |
| Silver nitrate | 170 g |
| Ammonium hydroxide (29.5%) | 161 g |
| Solution 3 | |
| Distilled water | 602 g |
| Ammonium bromide | 98 g |
| Potassium iodide | 3.3 g |

After Solution 1 was brought to 60° C., Solutions 2 and 3 are simultaneously jetted into Solution 1, with agitation, over a 50 minute period. Solution 2 had a flow rate of 15.9 g/min. and Solution 3 had a flow rate of 14 g/min. The emulsion temperature was held at 60° C. for 60 min. and then lowered to 20° C. The emulsion was flocculated with sulfuric acid and washed until the conductivity was below 500 μmhos/cm. The emulsion was reconstituted by adjusting the pAg to 9.0 and the pH to 5.7 and adding inert deionized gelatin to give a gelatin/-silver ratio of 0.5.

Figure 4:
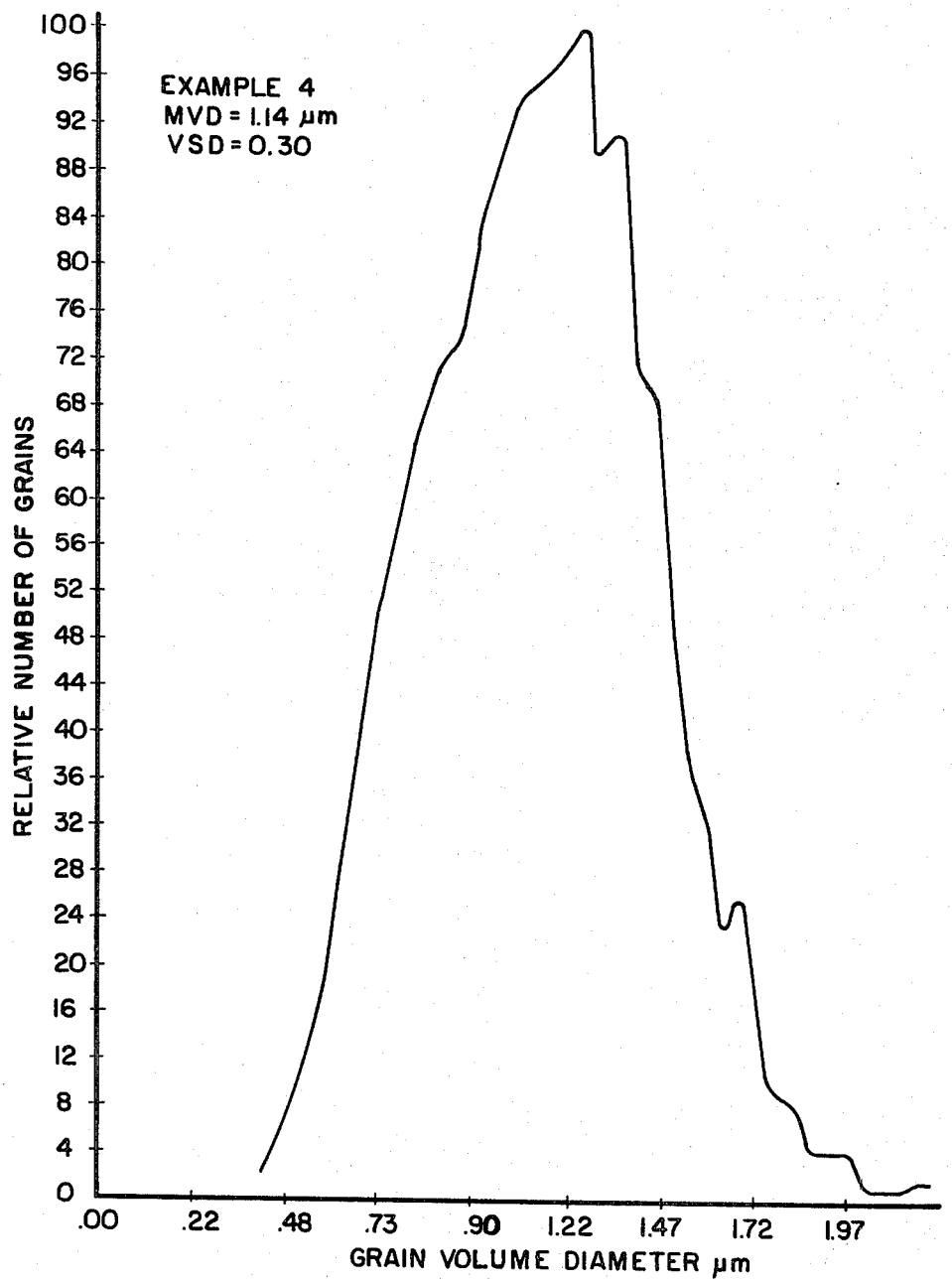

FIG. 4 is a grain size distribution curve obtained on the emulsion of Example 4.

EXAMPLE 5

The following solutions were prepared:

| | |
|---|---|
| Solution 1 | |
| Distilled water | 1082 g |
| Ammonium iodide | 8.0 g |
| Derivatized gelatin | 6.2 g |
| Solution 2 | |
| Distilled water | 500 g |
| Silver nitrate | 170 g |
| Ammonium hydroxide (29.5%) | 136 g |
| Solution 3 | |
| Distilled water | 890 g |
| Ammonium bromide | 116 g |
| Potassium iodide | 2.0 g |

After Solution 1 was brought to 60° C., Solutions 2 and 3 were simultaneously jetted into Solution 1, with agitation, over a 15 minute period. Solution 2 had a flow rate of 53.7 g/min. and Solution 3 had a flow rate of 67.2 g/min. The emulsion temperature was held at 60° C. for 40 min. and then lowered to 20° C. The emulsion was flocculated with sulfuric acid and washed until the conductivity was below 500 μmhos/cm. The emulsion was reconstituted by adjusting the pAg to 9.24 and the pH to 5.7 and adding inert deionized gelatin to give a gelatin/silver ratio of 0.5.

Figure 5:
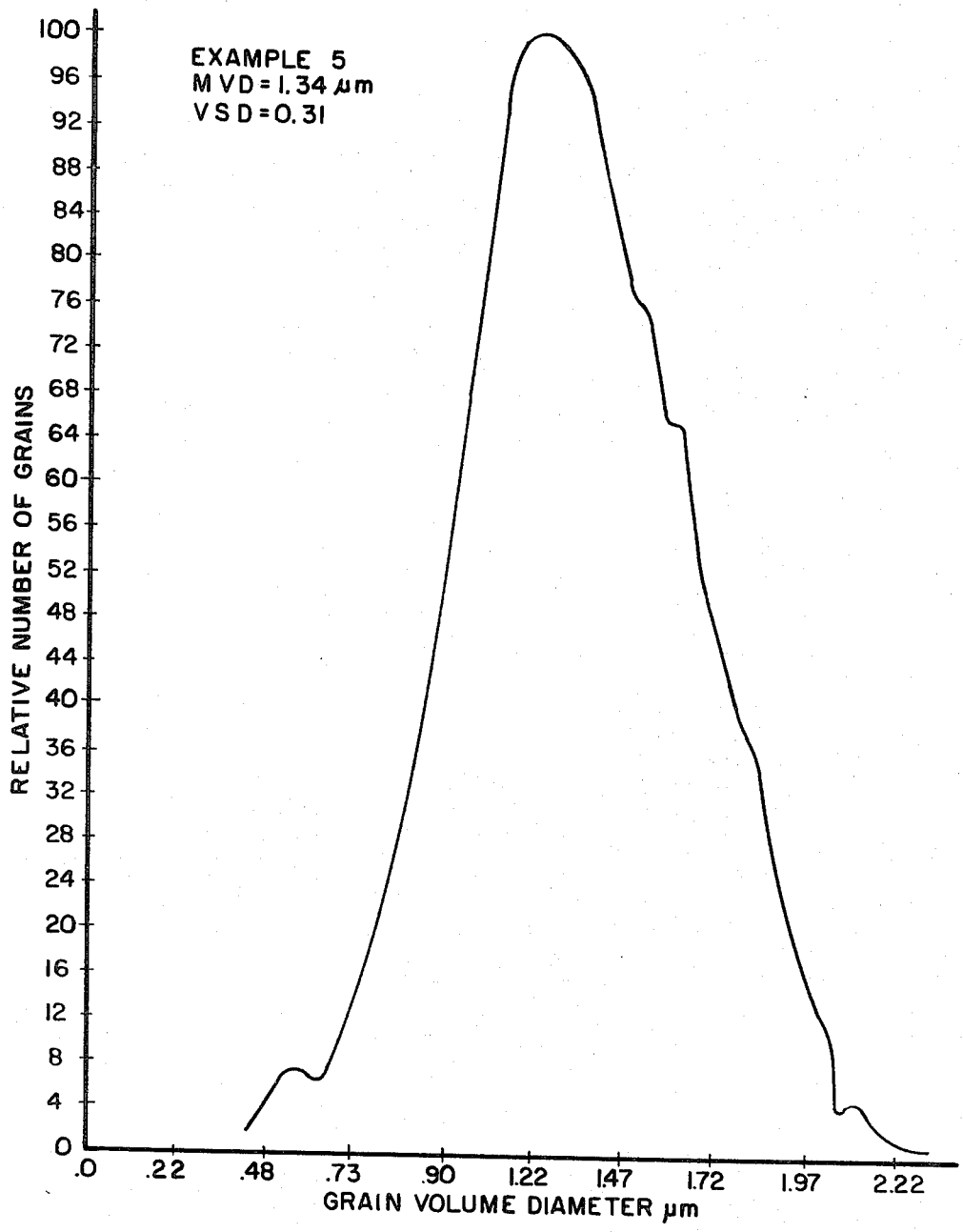

FIG. 5 is a grain size distribution curve obtained on the emulsion of Example 5.

EXAMPLE 6

The following solutions were prepared:

| | |
|---|---|
| Solution 1 | |
| Distilled water | 1460 g |
| Ammonium iodide | 10 g |
| Derivatized gelatin | 6.2 g |
| Solution 2 | |
| Distilled water | 499 g |
| Silver nitrate | 170 g |
| Ammonium hydroxide (29.5%) | 127 g |
| Solution 3 | |
| Distilled water | 602 g |
| Ammonium bromide | 98 g |

After Solution 1 was brought to 60° C., Solutions 2 and 3 were simultaneously jetted into Solution 1, with agitation, over a 50 minute period. Solution 2 had a flow rate of 15.9 g/min. and Solution 3 had a flow rate of 14.0 g/min. The emulsion temperature was held at 60° C. for 20 min. and then lowered to 20° C. The emulsion was flocculated with sulfuric acid and washed until the conductivity was below 500 μmhos/cm. The emulsion was reconstituted by adjusting the pAg to 9.24 and the pH to 5.7 and adding inert deionized gelatin to give a gelatin/silver ratio of 0.5.

Figure 6:
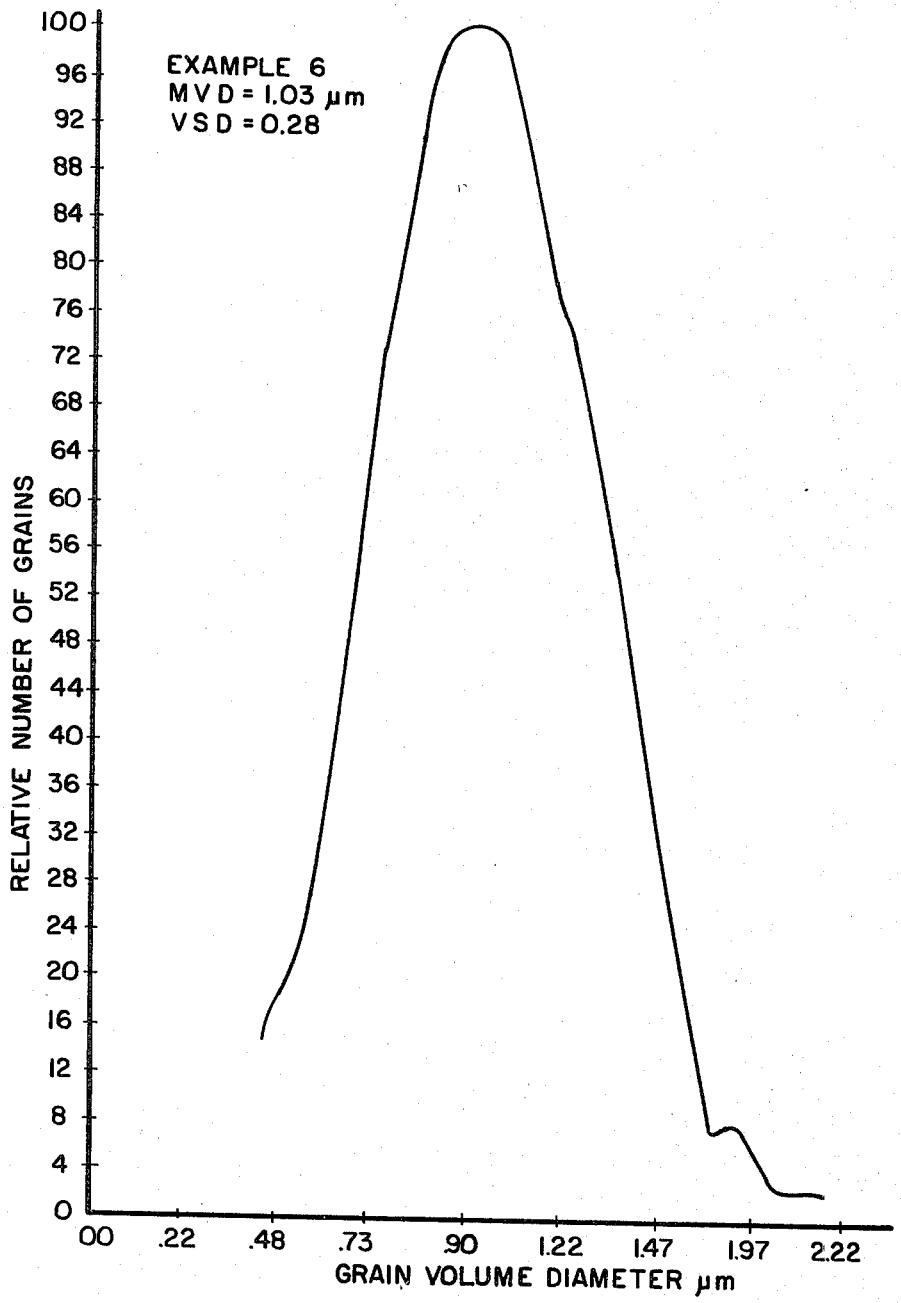

FIG. 6 is a grain size distribution curve obtained on the emulsion of Example 6.

EXAMPLE 7

The following solutions were prepared:

| | |
|---|---|
| Solution 1 | |
| Distilled water | 1294 g |
| Ammonium bromide | 3.4 g |
| Potassium iodide | 0.83 g |
| Deionized gelatin | 6.1 g |
| Solution 2 | |
| Distilled water | 499 g |
| Silver nitrate | 170 g |
| Ammonium hydroxide (29.5%) | 136 g |
| Solution 3 | |
| Distilled water | 602 g |
| Ammonium bromide | 98 g |

After Solution 1 was brought to 40° C., Solutions 2 and 3 were simultaneously jetted into Solution 1, with agitation, over a 30 minute period. Solution 2 had a flow rate of 27 g/min and Solution 3 had a flow rate of 23 g/min. The emulsion temperature was held at 40° C. for 20 min. before neutralizing with sulfuric acid. The emulsion was ultrafiltered until the conductivity was below 500 μmhos/cm. The emulsion was reconstituted by adjusting the pAg to 9.0 and the pH to 5.7 and adding inert deionized gelatin to give a gelatin/silver ratio of 0.5.

Figure 7:
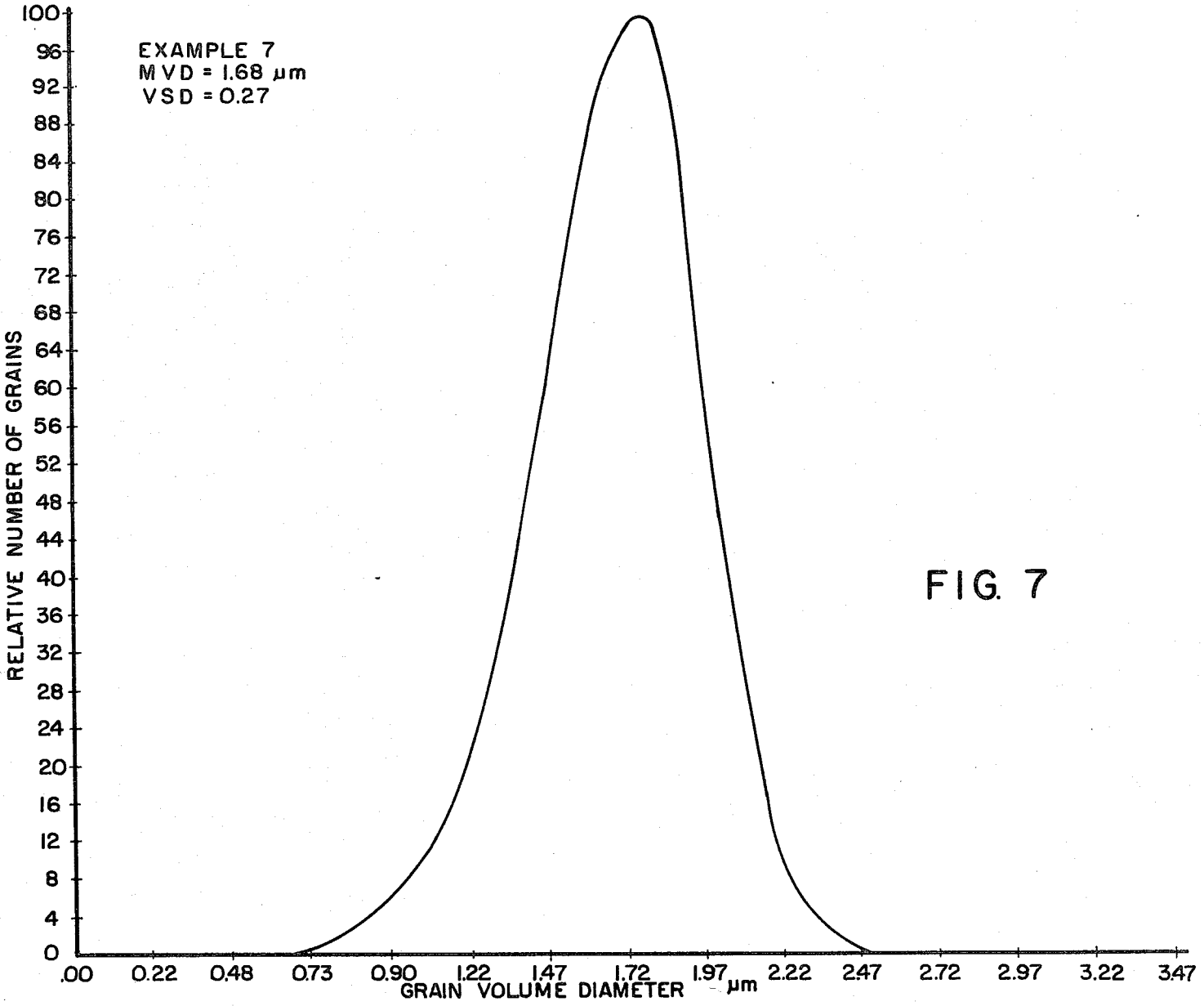

FIG. 7 is a grain size distribution curve obtained on the emulsion prepared of Example 7.

EXAMPLE 8

The following solutions were prepared:

| | |
|---|---|
| Solution 1 | |
| Distilled water | 1294 g |
| Ammonium bromide | 3.43 g |
| Potassium iodide | 0.8 g |
| Deionized gelatin | 6.1 g |
| Solution 2 | |
| Distilled water | 499 g |
| Silver nitrate | 170 g |
| Ammonium hydroxide (29.5%) | 136 g |
| Solution 3 | |
| Distilled water | 602 g |
| Ammonium bromide | 98 g |

After Solution 1 was brought to 40° C., Solutions 2 and 3 were simultaneously jetted into Solution 1, with agitation, over a 30 minute period. Solution 2 had a flow rate of 27 g/min and Solution 3 had a flow rate of 23 g/min. The emulsion temperature was held at 40° C. for 100 min. before neutralizing with sulfuric acid. The emulsion was ultrafiltered until the conductivity was below 500 μmhos/cm. The emulsion was reconstituted by adjusting the pAg to 9.0 and the pH to 5.7 and adding inert deionized gelatin to give a gelatin/siver ratio of 0.5.

Figure 8:
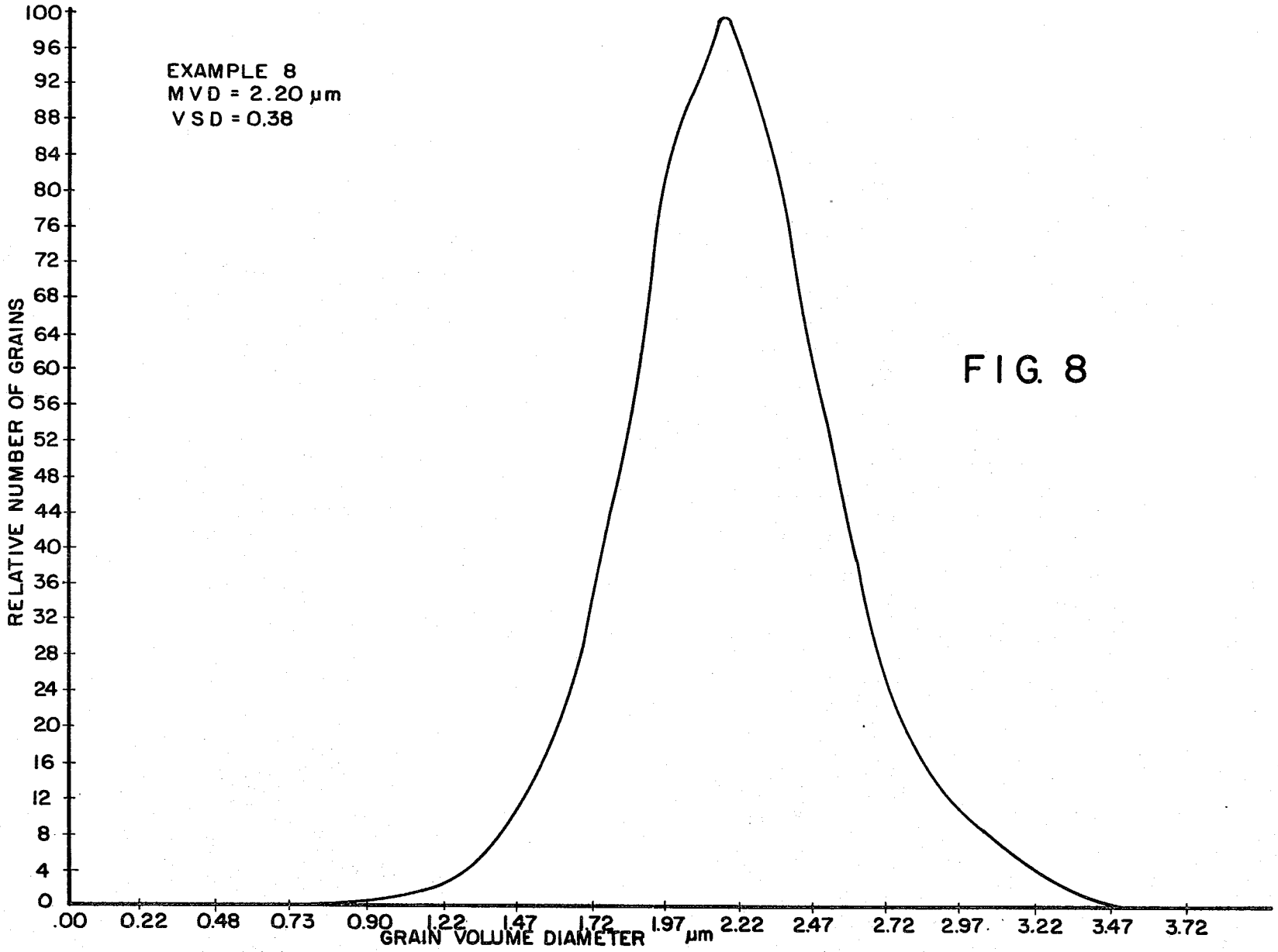

FIG. 8 is a grain size distribution curve obtained on the emulsion prepared of Example 8.

EXAMPLE 9

The following solutions were prepared:

| | |
|---|---|
| Solution 1 | |
| Distilled water | 1294 g |
| Ammonium iodide | 6.6 g |
| Deionized gelatin | 6.1 g |
| Solution 2 | |
| Distilled water | 499 g |
| Silver nitrate | 170 g |
| Ammonium hydroxide (29.5%) | 136 g |
| Solution 3 | |
| Distilled water | 601 g |
| Ammonium bromide | 96 g |
| Potassium iodide | 3.3 g |

After Solution 1 was brought to 40° C., Solutions 2 and 3 were simultaneously jetted into Solution 1, with agitation, over a 30 minute period. Solution 2 had a flow rate of 27 g/min and Solution 3 had a flow rate of 23 g/min. The emulsion temperature was held at 40° C. for 20 min. before neutralizing with sulfuric acid. The emulsion was ultrafiltered until the conductivity was below 500 μmhos/cm. The emulsion was reconstituted by adjusting the pAg to 9.0 and the pH to 5.7 and adding inert deionized gelatin to give a gelatin/silver ratio of 0.5.

Figure 9:
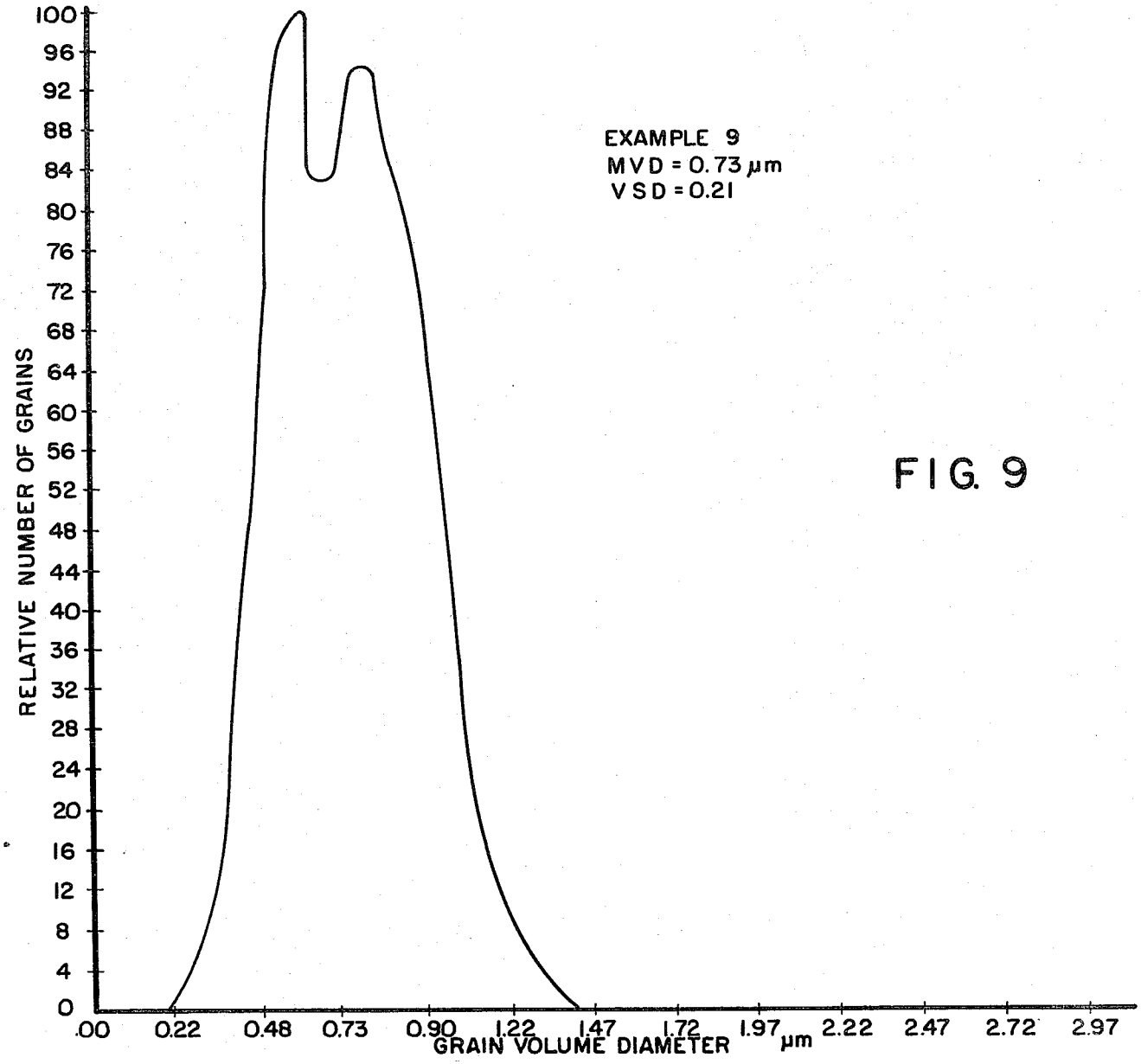

FIG. 9 is a grain size distribution curve obtained on the emulsion prepared of Example 9.

EXAMPLE 10

The following solutions were prepared:

| | |
|---|---|
| Solution 1 | |
| Distilled water | 1294 g |
| Ammonium iodide | 6.6 g |
| Derivatized gelatin | 6.1 g |

-continued

| | |
|---|---|
| Solution 2 | |
| Distilled water | 499 g |
| Silver nitrate | 170 g |
| Ammonium hydroxide (29.5%) | 136 g |
| Solution 3 | |
| Distilled water | 597 g |
| Ammonium bromide | 90 g |
| Potassium iodide | 13 g |

After Solution 1 was brought to 60° C., Solutions 2 and 3 were simultaneously jetted into Solution 1, with agitation, over a 50 minute period. Solution 2 had a flow rate of 16.1 g/min. and Solution 3 had a flow rate of 14.0 g/min. The emulsion temperatue was held at 60° C. for 100 min. and then lowered to 20° C. The emulsion was flocculated with sulfuric acid and washed until the conductivity was below 500 μmhos/cm. The emulsion was reconstituted by adjusting the pAg to 9.4 and the pH to 5.4 and adding inert deionized gelatin to give a gelatin/-silver ratio of 0.5.

Figure 10:
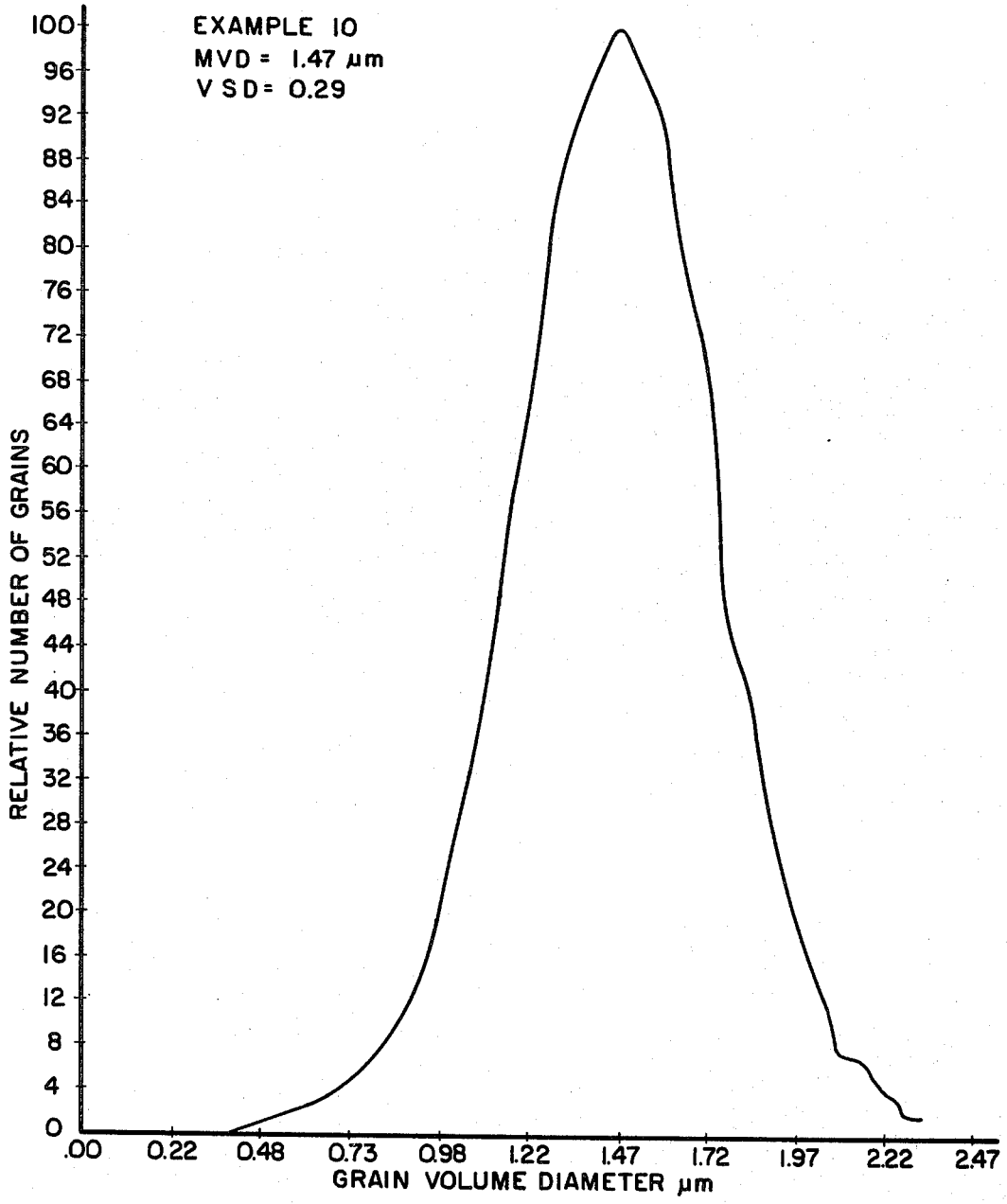

FIG. 10 is a grain size distribution curve obtained on the emulsion of Example 10.

EXAMPLE 11

The following solutions were prepared:

| | |
|---|---|
| Solution 1 | |
| Distilled water | 1294 g |
| Ammonium iodide | 6.6 g |
| Derivatized gelatin | 6.1 g |
| Solution 2 | |
| Distilled water | 499 g |
| Silver nitrate | 170 g |
| Ammonium hydroxide (29.5%) | 136 g |
| Solution 3 | |
| Distilled water | 590 g |
| Ammonium bromide | 80 g |
| Potassium iodide | 29 g |

After Solution 1 was brought to 60° C., Solutions 2 and 3 were simultaneously jetted into Solution 1, with agitation, over a 50 minute period. Solution 2 had a flow rate of 16.1 g/min. and Solution 3 had a flow rate of 14.0 g/min. The emulsion temperature was held at 60° C. for 100 min. and then lowered to 20° C. The emulsion was flocculated with sulfuric acid and washed until the conductivity was below 500 μmhos/cm. The emulsion was reconstituted by adjusting the pAg to 9.4 and the pH to 5.4 and adding inert deionized gelatin to give a gelatin/-silver ratio of 0.5.

The Table compares the mean volume diameter (MVD) and geometric volume standard deviation (VSD) of emulsions prepared according to the method of the present invention and a control emulsion.

TABLE

| | Grain Size μm (Coulter Count) | |
|---|---|---|
| Ex. No. | Mean Volume Diameter | Geometric Volume Standard Deviation |
| 1 (Control) | 1.55 | 0.47 |
| 2 | 0.94 | 0.24 |
| 3 | 1.57 | 0.38 |
| 4 | 1.14 | 0.30 |
| 5 | 1.31 | 0.31 |
| 6 | 1.03 | 0.28 |
| 7 | 1.68 | 0.27 |
| 8 | 2.20 | 0.38 |
| 9 | 0.73 | 0.21 |

TABLE-continued

| | Grain Size μm (Coulter Count) | |
|---|---|---|
| Ex. No. | Mean Volume Diameter | Geometric Volume Standard Deviation |
| 10 | 1.47 | 0.29 |

Figure 11:
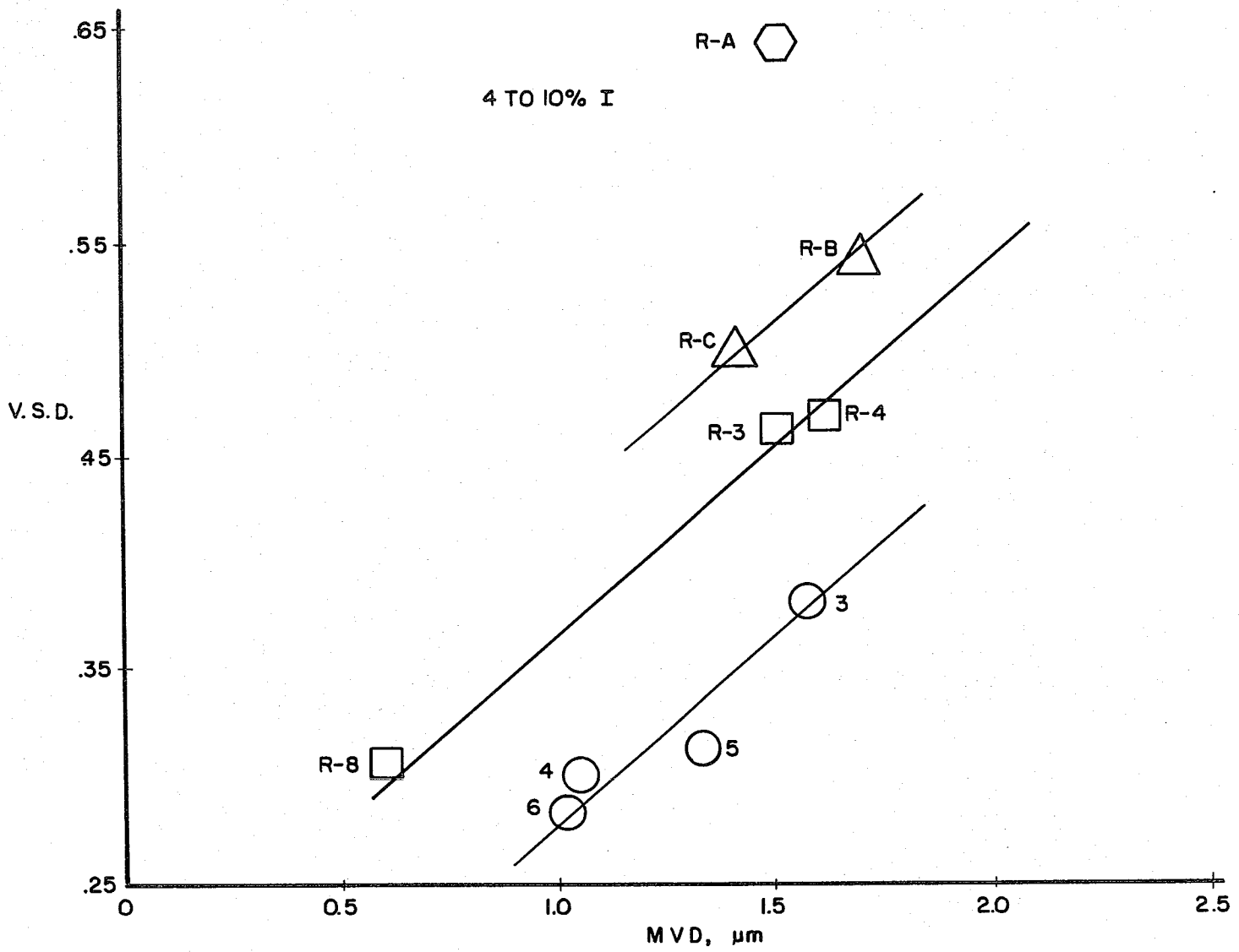
FIGS. 11 and 12 are plots of volume standard deviation versus mean volume diameter for emulsions of the present invention and prior art emulsions.

In order to show the advantages of the novel method of the present invention compared to prior art methods, a series of emulsions are compared with respect to grain size distribution in FIG. 11. All the emulsions whose grain size data are plotted in FIG. 11 have 4 to 10 mole % iodide. Emulsion R-A was prepared according to the procedure described in U.S. Pat. No. 3,647,458 (Tagliafico) with the modification that no iodide was jetted; Emulsion R-B was prepared according to the procedure described in Tagliafico without the above-described modification and Emulsion R-C was prepared according to the procedure described by Duffin, *Photographic Emulsion Chemistry,* The Focal Press, New York, 1966, page 16. Also plotted in FIG. 11 is the grain size distribution data for Examples 3, 4 and 8 from U.S. Pat. No. 4,259,438, issued Mar. 31, 1981, which are designated R-3, R-4 and R-8, respectively. These prior art emulsions are compared to the emulsions of the present invention prepared in Examples 3, 4, 5 and 6. It will be seen that, by means of the present invention, emulsions with relatively large grains possess a significantly narrower grain size distribution than grains of similar size and iodide content.

EMULSION R-A

The following solutions were prepared:

| | |
|---|---|
| SOLUTION 1 | |
| Distilled water | 1629 g |
| Ammonium bromide | 165.8 g |
| Potassium iodide | 18.0 g |
| Derivatized gelatin | 22.5 g |
| SOLUTION 2 | |
| Distilled water | 898.6 g |
| Ammonium hydroxide (28.6%) | 252.0 g |
| Silver nitrate | 306.0 g |
| SOLUTION 3 | |
| Distilled water | 1083.6 g |
| Ammonium bromide | 176.4 g |

After Solution 1 was brought to 57° C., Solution 2 was jetted into Solution 1 with mixing over a 12 minute period. The emulsion temperature was held at 57° C. for 15 minutes. Then Solution 3 was jetted into the combined solutions with mixing over a 12 minute period. The emulsion temperature was held at 57° C. for 20 minutes and then lowered to 20° C. The emulsion was then flocculated with sulfuric acid and washed until the conductivity was below 500 μmhos/cm$^2$.

EMULSION R-B

The following solutions were prepared:

| | |
|---|---|
| SOLUTION 1 | |
| Distilled water | 1629 g |
| Ammonium bromide | 165.8 g |
| Potassium iodide | 13.5 g |
| Derivatized gelatin | 22.5 g |
| SOLUTION 2 | |
| Distilled water | 898.6 g |
| Ammonium hydroxide (28.6%) | 252.0 g |
| Silver nitrate | 306.0 g |

-continued

| SOLUTION 3 | |
|---|---|
| Distilled water | 1083.6 g |
| Ammonium bromide | 176.4 g |
| Potassium iodide | 4.5 g |

After Solution 1 was brought to 57° C., Solution 2 was jetted into Solution 1 with mixing over a 12 minute period. The emulsion temperature was held at 57° C. for 15 minutes then Solution 3 was jetted with mixing over a 12 minute period. The emulsion temperature was held at 57° C. for 20 minutes and then lowered to 20°. The emulsion was then flocculated with sulfuric acid and then washed until the conductivity was below 500 $\mu$mhos/cm$^2$.

EMULSION R-C

The following solutions were prepared:

| SOLUTION 1 | |
|---|---|
| Distilled water | 1629 g |
| Ammonium bromide | 165.8 g |
| Potassium iodide | 18.0 g |
| Derivatized gelatin | 22.5 g |
| Ammonium hydroxide (5%) | 252 g |
| SOLUTION 2 | |
| Distilled water | 898.6 g |
| Silver nitrate | 306.0 g |
| SOLUTION 3 | |
| Distilled water | 1083.6 g |
| Ammonium bromide | 176.4 g |

After Solution 1 was brought to 57° C., Solutions 2 and 3 were simultaneously jetted into Solution 1 with mixing over a 12 minute period. The emulsion temperature was held at 57° C. for 20 minutes and then lowered to 20° C. The emulsion was then flocculated with sulfuric acid and washed until the conductivity was below 500 $\mu$mhos/cm$^2$.

Figure 12:
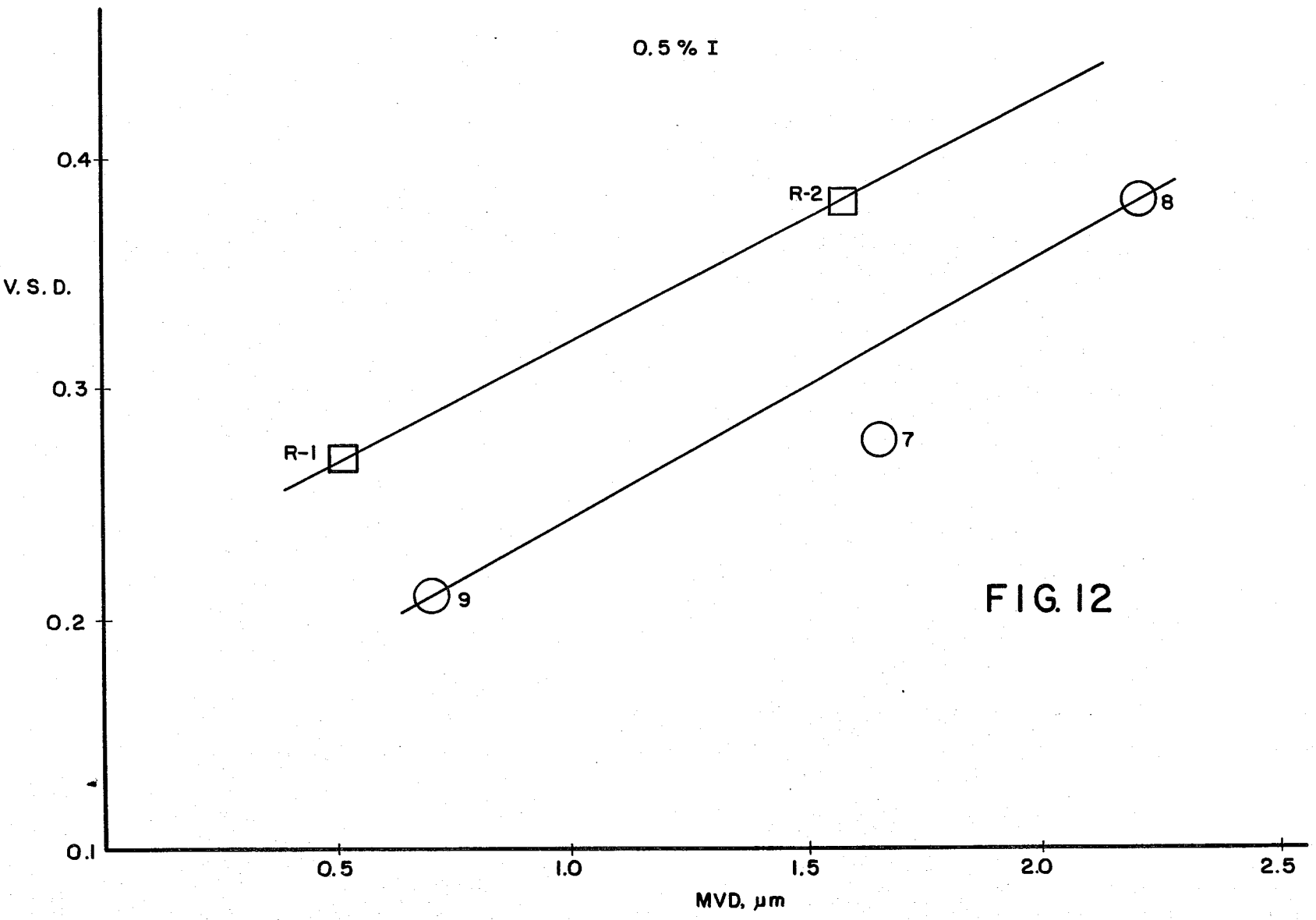

FIG. 12 compares emulsions containing 0.5 mole percent iodide prepared according to the procedure of U.S. Pat. No. 4,259,438 (Examples 1 and 2, designated R-1 and R-2, respectively, in FIG. 12) and the procedure of the present invention (Examples 7, 8 and 9). It will be seen that a significantly narrower grain size distribution is obtainable by means of the present invention compared to the procedure of U.S. Pat. No. 4,259,438 which produced narrow grain size distributions compared to the prior art.

Figure 13:
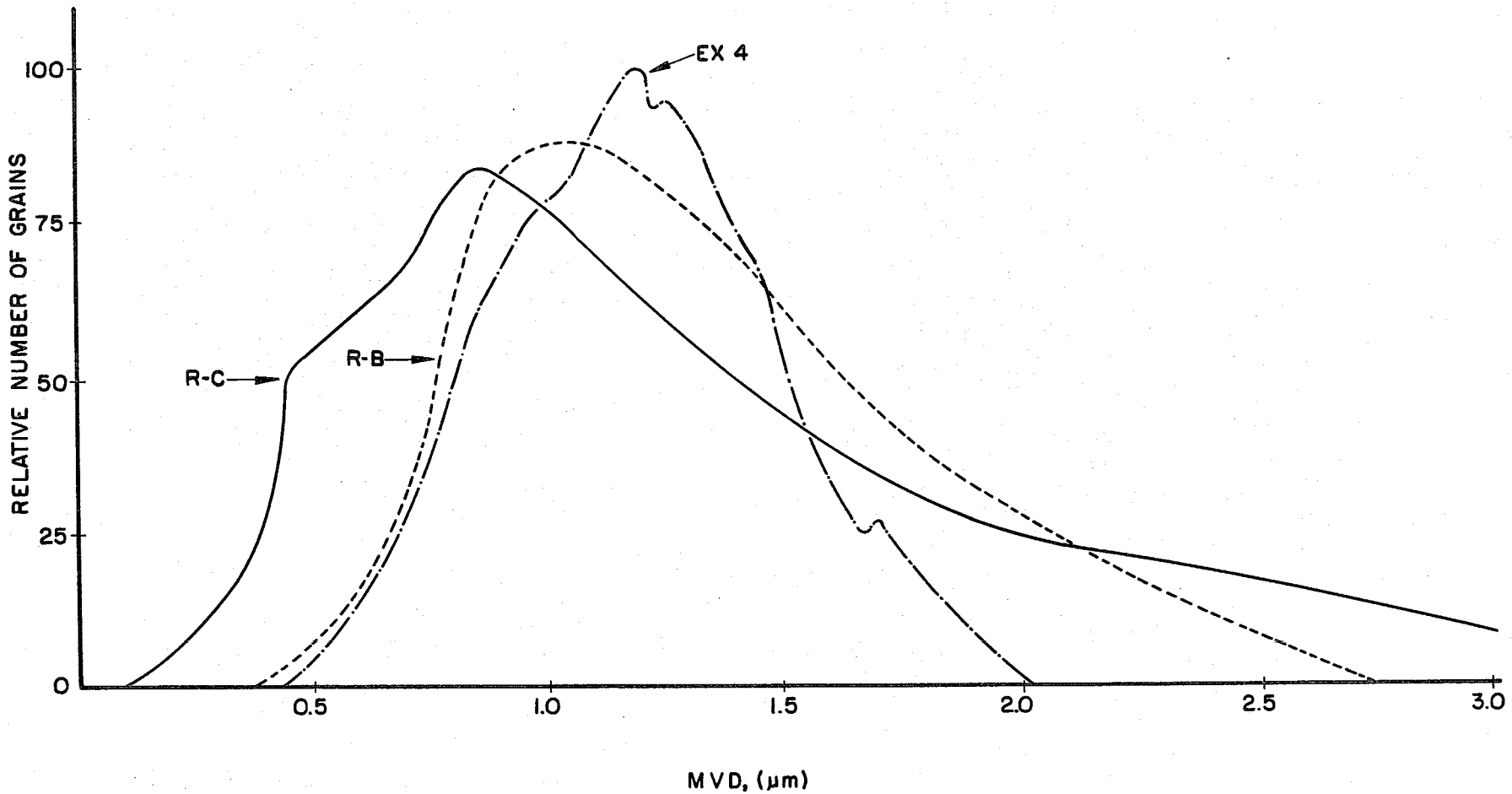
FIG. 13 is a comparison of grain size distribution curves of an emulsion of the present invention and prior art emulsions. The grain size distributions were obtained using a Coulter Counter.

FIG. 13 compares grain size distribution curves for Tagliafico emulsion R-B, and Duffin emulsion R-C, described above, with the emulsion of Example 4 of the present invention. The narrow grain size distribution character of the emulsion of the present invention is graphically exhibited, both at the higher and lower ends of the grain size scale. In other words, it will be seen that emulsion R-C has a significant number of grains smaller than the smallest of the emulsion of Example 4 and both the emulsions of R-C and R-B have a number of significantly larger grains than does the emulsion of the present invention.

With regard to the use of chemical sensitizing agents suitable for employment in the present invention, mention may be made of U.S. Pat. Nos. 1,574,944; 3,623,499; 2,410,689; 2,597,856; 2,597,915; 2,487,850; 2,518,698; 2,521,926; and the like as well as Neblette, C. B., *Photography, Its Materials and Processes,* 6th ED., 1962.

Spectral sensitization of the silver halide grains may be accomplished by contacting the grains with an effective concentration of the selected spectral sensitizing dyes dissolved in an appropriate dispersing solvent such as methanol, ethanol, acetone, water and the like; all according to the traditional procedures of the art, as described in Hamer, F.M., *The Cyanine Dyes and Related Compounds,* as well as the above-mentioned disposition of the sensitizers of the electrolyte solution prior to or during grain formation.

Reduction sensitization of the grains prior to or subsequent to the addition of the binder may also be accomplished employing conventional materials known to the art, such as stannous chloride.

Sensitizers of the solid semiconductor type, such as lead oxide, may also be employed.

Additional optional additives, such as coating aids, hardeners, viscosity-increasing agents, stabilizers, preservatives, and the like, also may be incorporated in the emulsion formulation, according to the conventional procedures known in the photographic emulsion manufacturing art.

I claim:

1. A method for forming photosensitive silver iodobromide emulsions having a narrow grain size distribution which comprises precipitating silver iodobromide grains by simultaneously introducing a first ammoniacal solution of silver nitrate and a second solution of ammonium bromide into a third ammoniacal solution consisting essentially of gelatin and a water-soluble iodide salt under conditions wherein silver ions are not in excess during said precipitation, wherein said third solution contains less than 4 mole percent of a water-soluble bromide salt and wherein said grains contain about 0.5 to 25 mole percent iodide.

2. The method of claim 1 wherein said water-soluble iodide salt is ammonium iodide.

3. The method of claim 1 wherein said bromide salt is ammonium bromide.

4. The method of claim 3 wherein said iodide salt is sodium or potassium iodide.

5. The method of claim 1 wherein said second solution includes a water-soluble iodide salt.

6. The method of claim 5 wherein said iodide salt is potassium iodide.

7. The method of claim 1 which includes the step of ripening said grains to a predetermined grain size.

8. The method of claim 1 wherein said grains contain about 0.65 to 14 mole percent iodide.

9. The method of claim 1 wherein said grains are chemically sensitized.

10. The method of claim 1 wherein said grains are optically sensitized.

* * * * *